United States Patent [19]

Beekenkamp

[11] 4,073,484

[45] Feb. 14, 1978

[54] PORTABLE WORKBENCH ASSEMBLY

[75] Inventor: Gerald Beekenkamp, Etobicoke, Canada

[73] Assignee: The Black and Decker Manufacturing Company, Towson, Md.

[21] Appl. No.: 728,940

[22] Filed: Oct. 4, 1976

[51] Int. Cl.[2] ..... B25B 1/22; A47B 3/02

[52] U.S. Cl. ..... 269/321 CF; 108/118; 144/286 R

[58] Field of Search ..... 269/321 CF; 144/286 R; 108/118, 119; 248/164, 166, 432, 434

[56] References Cited

U.S. PATENT DOCUMENTS

| | | | |
|---|---|---|---|
| 2,845,317 | 7/1958 | Orman | 108/119 |
| 3,001,559 | 9/1961 | Szopo | 144/286 R |
| 3,134,192 | 5/1964 | Huffer | 108/119 |

*Primary Examiner*—Robert C. Watson

*Attorney, Agent, or Firm*—Walter Ottesen; Edward D. Murphy; Leonard Bloom

[57] ABSTRACT

The invention is directed to a portable workbench which includes a foldable support stand and a workpiece supporting and clamping assembly supported thereon. The workpiece supporting and clamping assembly has a base frame and a pair of elongated top members located on the base frame and defining upper work supporting surfaces lying generally in a common plane and having opposed side portions defining clamping surfaces. A clamping arrangement is operatively connected between the base frame and one of the top members for moving the latter toward and away from the other top member to provide for the clamping of workpieces between the top members. The support stand includes a pair of generally rigid frames, with each frame having spaced apart upper and lower longitudinally extending generally horizontal members. Pivot-like joints on the frames permit the frames to be pivoted relative to one another between an open support position where the frames are angularly arranged relative to one another with their horizontally extending members being in spaced apart relation, to a folded position wherein the frames are in juxtaposition to one another. Resilient clips on said base frame releasably engage with the uppermost horizontally extending members when the support stand is in the open support position to secure the workpiece supporting and clamping assembly to the support stand when in use and to permit the workpiece supporting and clamping assembly to be removed therefrom to facilitate handling and storage of the portable workbench.

3 Claims, 18 Drawing Figures

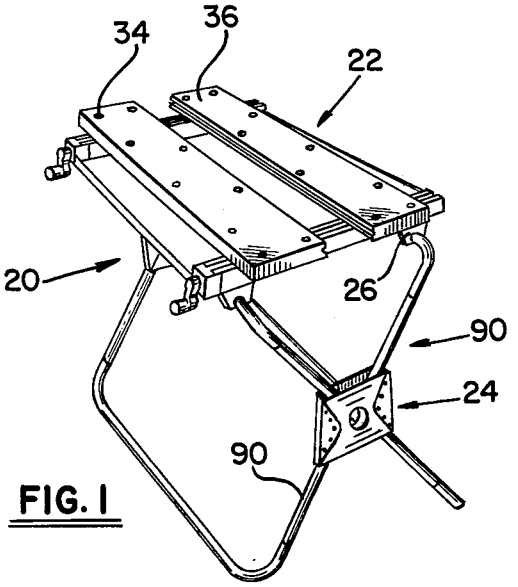
FIG. 1
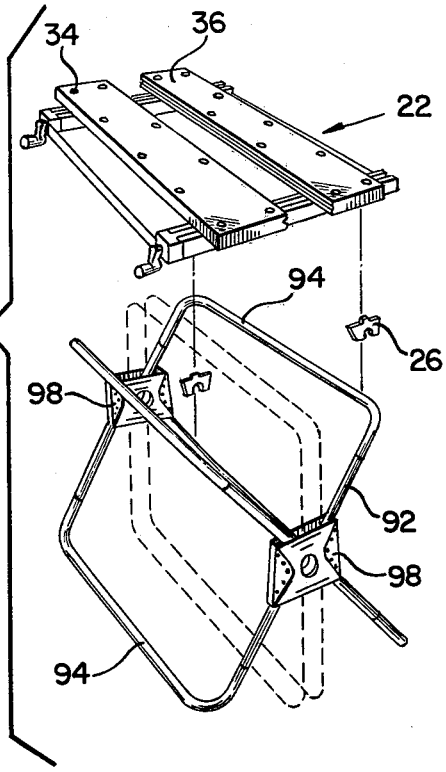
FIG. 2
FIG. 3
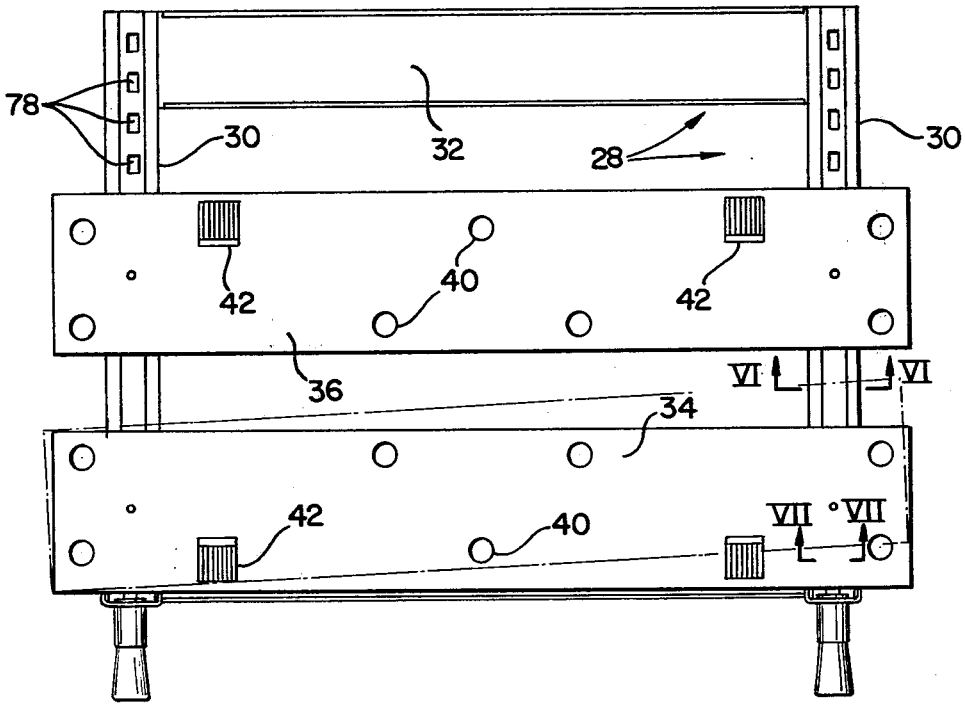
FIG. 4
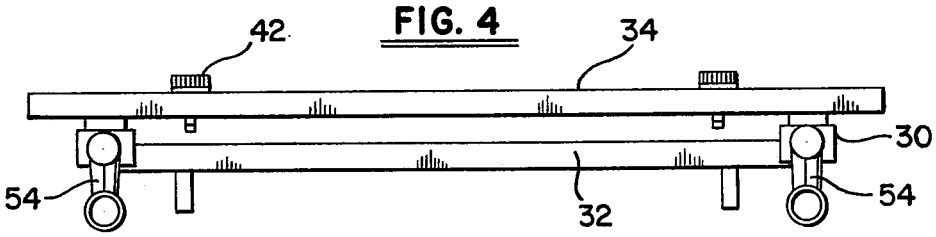

PORTABLE WORKBENCH ASSEMBLY

BACKGROUND OF THE INVENTION

This invention relates to a portable workbench of the collapsible type including a foldable support stand and a workpiece supporting and clamping assembly supported thereon.

The prior art has provided a variety of types of workbench or workbench-like structures including a foldable support stand which serves to support a tray or other suitable form of table-top-like surface. Many of these structures are suitable for use as serving stands or tables for supporting dishes etc., in restaurants and the like. Typical examples of such structures may be found in U.S. Pat. No. 2,354,941 dated Aug. 1, 1944 to Treitel, in U.S. Pat. No. 3,106,295 dated Oct. 8, 1963 to Berlin, and in U.S. Pat. No. 2,802,578 dated Aug. 13, 1967 to Barile. The prior art also includes various arrangements wherein the support stand is operatively connected to a workbench such as in U.S. Pat. No. 1,688,533 issued Oct. 23, 1948 to Eger. In this arrangement the support legs are interconnected together by spaced apart linkage members which maintain the legs in parallelism in both the open support position and the folded storage position. A more recent and highly successful development is shown in U.S. Pat. No. 3,615,087 dated Oct. 26, 1971 to R. P. Hickman. This patent discloses a workbench arrangement including a work supporting and clamping assembly which is interconnected to a base structure by supporting members which are capable of movement between a collapsed position wherein the workbench portion is in close juxtaposition to the base structure and a working position in which the workbench is spaced from and supported above the base structure.

SUMMARY OF THE INVENTION

It is a general object of the present invention to provide an improved workable workbench of the general type illustrated in the Hickman patent referred to above but wherein the work supporting and clamping assembly is readily separable from a foldable support stand structure thereby to enable the workbench to be readily carried from place to place and set up in the working position with a minimum of effort and which can be disassembled quickly, carried back to the storage area and stored in a relatively small space.

Accordingly, the objects of the inventions include the provision of a portable workbench assembly which is of a simple sturdy construction, which is light in weight and which is separable into two balanced portions for ready portability, which may be set up and dismantled with a minimum of effort, which is arranged so as to be stable when in use, which is economical to manufacture, and which is compact to store and to package.

Accordingly, the invention provides, in one aspect, a portable workbench including a foldable support stand and a workpiece supporting and clamping assembly disposed thereon. The workpiece supporting and clamping assembly includes a base frame with a pair of elongated top members located on the base frame and defining upper work supporting surfaces lying generally in a common plane and having opposed side portions defining clamping surfaces. Clamping means are operatively connected between the base frame and one of the top members for moving the latter toward and away from the other top member to provide for the clamping of workpieces therebetween. The support stand includes a pair of generally rigid frames each frame having spaced apart upper and lower longitudinally extending members which are horizontally disposed when in use with means defining pivot points on the frames to permit the frames to be pivoted relative to one another between an open support position and a folded position. In the open support position the frames are angularly arranged relative to one another with their horizontally extending members in spaced apart relation while in the folded position the frames are in close juxtaposition to one another. Suitable means, preferably resilient clip means, are provided on the base frame to releasably engage the uppermost horizontally extending members of the support stand when the latter is in the open support position. These means act to secure the workpiece supporting and clamping assembly to the support stand while it is in use; they furthermore permit the workpiece supporting and clamping assembly to be quickly removed from the support stand thereby facilitating handling and storage of the portable workbench.

The above referred to workpiece supporting and clamping assembly is preferably, but not necessarily, constructed in accordance with the teachings of co-pending U.S. patent application Ser. No. 665,201 filed Mar. 9, 1976 and entitled "Workpiece Supporting and Clamping Apparatus". The assembly disclosed in this application includes a generally rigid base frame having a pair of elongated top members mounted thereon and lying in a common plane in side-by-side relationship. Longitudinally extending side portions of the top members define surfaces for the clamping of workpieces therebetween. Suitable clamping means are operatively connected between one of the top members and the base frame to move such top member back and forth to an infinite number of positions along the base frame. Locator means are associated with the other top member thereby to allow it to be manually indexed to and located at any one of a plurality of predetermined positions along the base frame thereby allowing such top member to be quickly positioned relative to the first top member approximately in accordance with the dimensions of the workpiece to be clamped. The clamping means may then be operated to move the first mentioned top member the required distance as to provide the desired clamping forces.

The above referred to foldable support stand is preferably, but not necessarily, constructed in accordance with the teachings of my co-pending U.S. patent application Ser. No. 728,939 filed Oct. 4, 1976 and entitled "A Foldable, Portable Support Stand". The above patent application discloses a support structure comprising a pair of rigid frames with each frame having a spaced apart pair of tubular end legs and a spaced apart pair of longitudinally extending tubular members, the end legs and the longitudinally extending members being interconnected together to provide the frame with a rectangular outline configuration. The end legs of the frames are in a cross-over-relationship with one another. Each of the end legs has a bight portion therein with the bight portions of the end legs of one of the frames being in mating relation with the respective bight portions of the end legs of the other frame. The mating bight portions define pivot joints for permitting pivotal movement of the frames relative to one another between the folded position wherein the frames are in close juxtaposition with one another and an open support position wherein the frames are angularly arranged relative to one another. A housing is associated with each of the pivot joints for maintaining the bight portions in mating relation, such housing including shoulder means defining the open support position of the frames relative to one another.

In a preferred form of the invention the support stand includes means thereon at the region where the legs cross one another to take up laterally directed force components when the frames are in the open position. In the preferred embodiment such means take the form of a housing arrangement located at the cross-over regions of the end legs, such housing means having shoulder means defined thereon against which portions of the end legs bear thereby to take up laterally directed force components. This arrangement affords a significant advantage over prior art structures wherein the laterally directed components of force are taken up by the means interconnecting the support frame with the means defining the working surface. By virtue of the above described arrangement substantially only vertically directed force components are transmitted between the support stand and the base frame portion of the workpiece supporting and clamping assembly.

As noted above, it is preferred that suitable resilient clip means be provided for interconnecting the workpiece supporting and clamping assembly to the foldable support stand. In a further aspect of the invention the resilient clip means are capable of limited movement in the lateral direction so that, in use, the clip means are free to move laterally a sufficient distance as to compensate for tolerance accumulations and any deflections due to loading in the base frame and in the frames of the support stand thereby to further ensure that vertically directed force components only are transmitted between the support stand and the base frame. By arranging for the resilient clip means to move limited distances in the lateral direction, one is assured that all of the laterally directed force components are taken up by the above-referred to shoulder means thus reducing the possibility of failure of the resilient clip means under heavy loads.

The above objectives and advantages of my invention will become more apparent from a consideration of the detailed description to follow taken in conjunction with the drawing annexed hereto.

BRIEF DESCRIPTION OF THE DRAWING

The drawing which illustrates embodiments of the invention includes:

FIG. 1 is a perspective view of a workbench in accordance with the invention showing the workpiece supporting and clamping assembly disposed on a support stand;

FIG. 2 is a further perspective view showing the clamping assembly separated from the support stand;

FIG. 3 is a plan view of the workpiece clamping assembly per se;

FIG. 4 is a front elevation view of the assembly shown in FIG. 3;

DESCRIPTION OF THE PREFERRED EMBODIMENTS OF THE INVENTION

Figure 5:
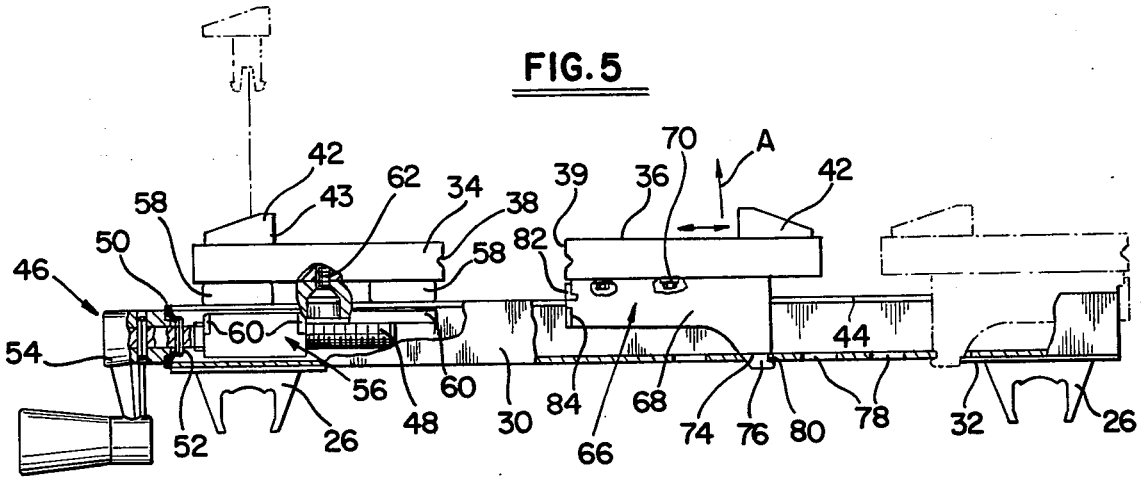
FIG. 5 is an end elevation view of the workpiece supporting and clamping assembly.

With reference to FIGS. 1 and 2, there is shown a workbench 20 according to the invention including a workpiece supporting and clamping assembly 22 and a foldable support stand 24 therefor. The assembly 22 is detachably secured to the support stand 24 by clips 26 which resiliently engage the upper horizontally disposed members of the support stand 24 in the manner to be hereinafter described.

The assembly 22, as set forth in my above-noted copending application, includes a generally rigid metal base frame 28 having a rectangular outline in plan (FIG. 3) and including a spaced apart parallel pair of channel members 30, rigidly connected together by a further spaced apart pair of transverse frame members 32. All of the above frame members are of relatively heavy gauge sheet metal and are securely welded together so as to impart to the base frame 28 the necessary resistance to distortion when under stress.

Base frame 28 serves to support a pair of elongated beams 34 and 36 each having a rectangular outline in plane, both of which are preferably of a laminated wood construction. The beams 34, 36 are disposed in a common plane above channel members 30 and extend generally transversely thereto with the opposing end of beams 34, 36 extending outwardly beyond the channel members 30 a short distance. The relatively broad beams 34, 36, have their upper surfaces in a common plane and serve to define table-like working surfaces. The opposed, confronting, longitudinally extending side portions of the two beams define clamping surfaces 38, 39 (FIG. 5) between which a workpiece may be clamped when beam 34 is moved toward beam 36 in the manner to be hereinafter described. The clamping surfaces 38, 39 advantageously each have a shallow longitudinally extending V-shaped-in-cross-section concavity therein to assist in holding certain articles, such as pipes or dowels, between the beams. Certain types of workpieces may be of such a shape that they cannot readily be clamped between the above described clamping surfaces 38, 39. Accordingly, the two beams 34, 36 are also preferably provided with a plurality of spaced apart apertures 40 therein which extend at right angles to their upper, work supporting surfaces. Apertures 40 are used to receive workpiece engaging pegs 42. These pegs are fitted into desired ones of the apertures 40 in accordance with the configuration of the workpiece such that when the beam 34 is moved toward beam 36 (or moved away from it depending on circumstances) the vertical faces 43 of the heads of the pegs engage the workpiece and assist in holding it firmly on the working surface defined by the beams 34, 36.

The means for retaining the beams 34, 36 on frame channel members 30 and permitting the selective indexing of beam 36 and the movement of the beam 34 to provide for the rapid clamping up of different sizes of workpieces will now be described.

Firstly, it will be seen that channel members 30 are of a rectangular box-beam like configuration in cross-section (FIGS. 6 and 7) and include spaced side walls and a bottom with the upper surfaces of the channels 30 being defined by a spaced pair of inwardly directed flanges 44 with the inner free edges of these flanges being in spaced apart relationship. The beam 34, which may be termed the front beam, is operatively connected to the channels 30 via a pair of independently operable screw actuated clamping means 46, each associated with a respective one of the ends of front beam 34. Each clamping means 46 includes an elongated screw 48 rotatably mounted in a plate 50 welded to the front end of an associated channel 30. Each screw 48 extends rearwardly within its associated channel 30 a desired distance depending upon the degree of travel required for the front beam 34. Axial motion of each of the screws 48 is prevented by means of pin and washer assembly 52 disposed on the screw on the rear side of plate 50, and by a crank handle 54 (preferably of moulded plastics) secured by a suitable pin on the end of the screw on the opposite (front) side of plate 50. Screws 48 extend through and are threadably engaged with respectively associated slide blocks 56 (FIG. 5) upon which the opposing ends of the front beam 34 are mounted. Each slide block 56 is of a sturdy moulded plastics material (in order to, among other things, reduce friction between itself and the channel 30) and includes vertically spaced apart outwardly extending sets of projections 58 and 60. The upper projections 58 define support shoulders which rest on the upper surfaces of the inwardly directed channel flanges 44 while the lower projections 60 underlie the lower surfaces of the flanges 44 and prevent upward tilting motion of the slide blocks 56 relative to the channel 30. An axially extending threaded bore in each slide block 56 receives its associated elongated screw 48. As each screw 48 is rotated, the slide block associated with same is made to slide back and forth along its associated channel member 30. The central portion of each slide block 56 is provided with an aperture through which extends, at right angles to screw 48, a sturdy threaded fastener 62 (FIG. 5), the upper end of which is threaded into an associated end portion of front beam 34 to thereby secure the opposing end portions of the beam to the slide blocks 56 while at the same time permitting angular motion therebetween about the axes defined by fasteners 62. Thus, as hand cranks 54 are rotated, the front beam 34 will be moved along the channels 30 towards or away from the rear beam 36. Rotation of only one of the cranks will effect angular motion of the beam 34 about the axes defined by the fasteners 62 connecting such beam to the slide blocks 56 and will allow the front beam to be angularly adjusted about a vertical axis relative to the rear beam (see dashed line outline of beam 34 in FIG. 3). This angular adjustment feature is of importance especially when various tapered articles are to be clamped between the two beams. In order to permit this angular adjustment of the front beam 34, the slide blocks 56 are given a reasonable degree of freedom laterally relative to their associated channel members 30 thereby to eliminate problems of the slide blocks 56 sticking or binding in their associated channel members 30. Suitable stop means to limit the degree of rearward travel of the slide blocks 56 may be located in the frame channels 30 thereby preventing the screws 48 from becoming disengaged from the slide blocks 56.

Figure 6:
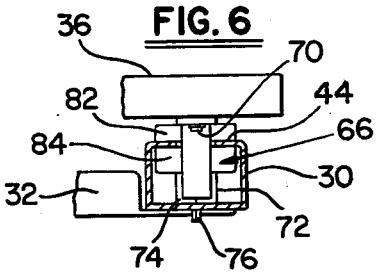
FIGS. 6 and 7 are elevation views, partially in section 1 taken along lines VI—VI and VII—VII in FIG. 3.
Figure 7:
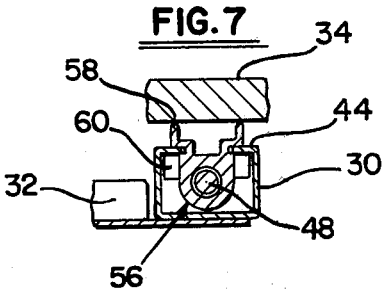

The back beam 36 is provided with means enabling same to be quickly selectively indexed to any one of a plurality of fixed positions along channels 30. Accordingly, the back beam 36 is attached adjacent its opposing ends to respective beam locators 66 (FIGS. 5, 6). The locators 66 are preferably each of heavy sheet metal construction and include an elongated hollow body 68, the upper flat surface of which is securely attached to the back beam 36 by a screw fastener 70. The side walls 72 of body 68 fit, with reasonable clearance, between the edges of the inwardly directed channel flanges 44. The lower edges of the side walls curve downwardly toward the rear of body 68 and thence are turned inwardly to form a flat base 74 at the rear of body 68, which base 74 rests on the bottom or floor of channel 30. Integrally formed with base 74 is a downwardly extending foot 76 which is sized to project through any one of a plurality of aligned rectangular apertures 78 formed in the floor of its associated channel 30. The rear edge of foot 76 has a shallow notch 80 therein (FIG. 5). Notch 80 engages the edge of the aperture 78 when thrust forces are applied to back beam 36.

Those skilled in the art will realize that means other than apertures 78 may be provided for engagement with the feet of the beam locators 66. For example the floor of the channel may have protuberances or recesses formed therein and spaced therealong for engaging said feet portions and taking up the thrust forces applied to the beam 36.

In order to guide and support the front portion of each beam locator 66, outwardly directed pairs of upper and lower tabs 82, 84 respectively, are formed on each of the side walls 72 at the frontal edges of same. The upper pair of tabs 82 overlie the upper surfaces of the inwardly directed channel flanges 44 while the lower tabs 84 underlie the lower surfaces of these flanges 44. When one desires to index or reposition the back beam 36, the back beam is shifted forwardly slightly until the notches 80 are clear of the edges of apertures 78. The beam 36 and its attached locators 66 are then rotated in the direction of arrow A in FIG. 5 about the pivot point provided by the spaced pairs of tabs 82, 84 until feet 76 are fully withdrawn from the apertures 78. The entire beam 36 with its attached locators 66 may be then easily slid along the channels 30 until the desired location (which location depends on the dimensions of the workpiece to be clamped) is reached, at which point the beam 36 is rotated in the opposite direction to insert the feet 76 of the locators into the apertures 78 of the spaced channels 30. Since thrust forces applied to the back beam 36 by a workpiece clamped in tension or compression apply a torque to the entire beam and locator assembly in a direction which tends to thrust the feet 76 fully into the apertures 78, there is almost no possibility of the back beam 36 becoming accidentally dislodged and thus allowing the workpiece to be released during normal use.

It is also to be noted here that the rear ends of the channels 30 are "open" thus permitting the back beam 36 to be slid rearwardly and removed from the assembly and replaced in the "reversed" position shown in phantom in FIG. 5. The "reversed" position is used when a workpiece is of such a configuration that it is best held in tension between the two beams. In this instance the pegs 42 on the two beams are disposed such that they can engage certain internal surfaces of the workpiece. The rear beam is indexed to the desired position and the front beam 34 made to move away from the rear beam 36 to thereby hold the workpiece in tension between the two beams.

The manner in which the above described structure is operated to effect clamping of a workpiece will be apparent from the above description. The means for allowing the rear beam 36 to be quickly selectively indexed to one of a plurality of predetermined locations is of considerable advantage as it reduces the time necessary to clamp a workpiece in place as compared with devices having only a screw-type clamping arrangement.

This saving in time is very apparent when a plurality of widely varying sizes of workpieces are to be clamped in sequence between the beams 34, 36. The back beam 36 is quickly positioned in each case in accordance with the appropriate dimensions of the workpiece with the final clamping action being provided by actuating the screw-type clamping devices associated with the front beam 34.

It is also noted here that the locators 66 at the opposite ends of the rear beam 36 may be indexed to different locations relative to one another along their associated channels 30, that is, one locator 66 may be positioned somewhat more rearwardly or forwardly as compared with the opposite locator 66 thereby, effectively providing for a limited degree of angular adjustment of the rear beam 36 about an axis normal to the common plane defined by the upper surfaces of the beams 34, 36. During the course of this adjustment, the beam 36 rotates relative to the two locators 66 about the spaced apart axes defined by the above mentioned fasteners 70 which connect the locators 66 to the beam 36, said spaced apart axes being normal to the above mentioned common plane. The locators 66 have a sufficient degree of lateral freedom in their associated channels 30 as to permit the desired amount of angular adjustment to be effected. With the angular adjustment thus afforded, rear beam 36 may be used to complement the angular adjustment provided for the front beam 34 by the independently operable screw clamping devices and facilitates the clamping of workpieces having a high degree of taper.

Figure 8:
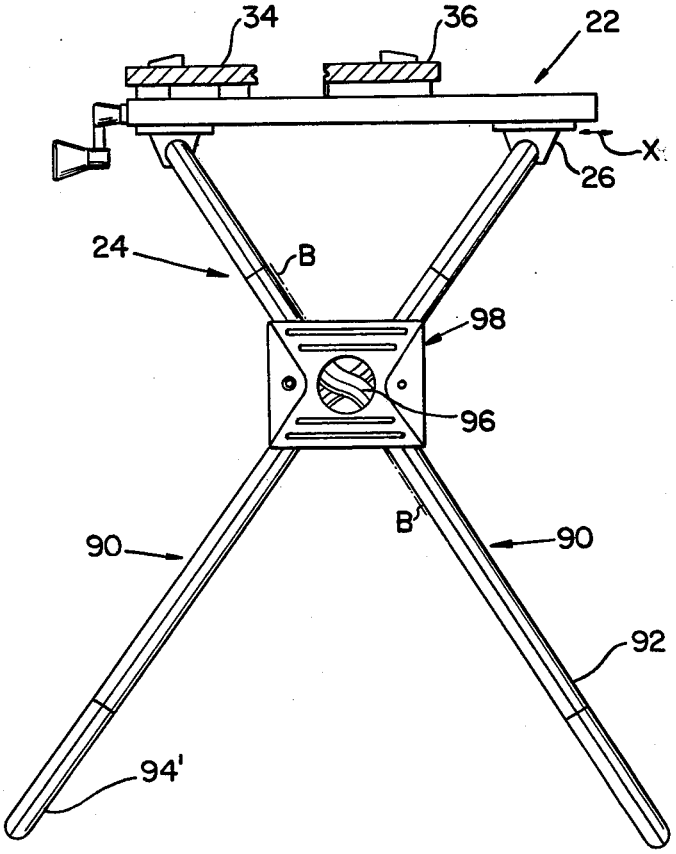
FIG. 8 is an end elevation view of the workbench assembly.
Figure 9:
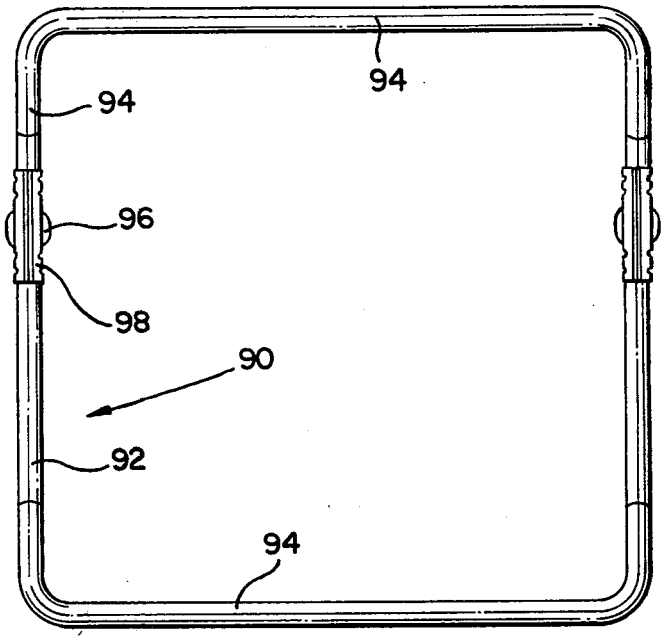
FIG. 9 is a side elevation view of the support stand per se.
Figure 10:
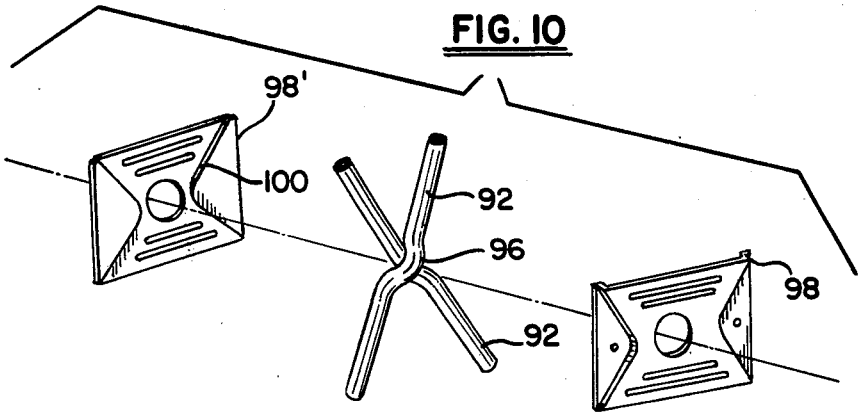
FIG. 10 is an exploded view of the pivot joint assembly and support housing therefor.

With additional reference to FIGS. 8, 9 and 10, the foldable support stand 24 (which forms the subject of my co-pending application noted above) will be seen to include a pair of frames 90, each frame having a generally rectangular outline configuration. Each frame includes a spaced apart pair of end legs 92 and a spaced apart pair of longitudinally extending members 94. The end legs 92 and the longitudinally extending members 94 are interconnected together to provide the above mentioned generally rectangular configuration. End legs 92 and longitudinally extending members 94 each comprise steel tubes having a wall thickness and outside diameter sufficient as to impart to the final structure the required degree of rigidity. The upper and lower longitudinally extending members 94 are identical to one another. The end legs 92 are also all identical to one another, thus reducing manufacturing costs. It will be seen that the opposing end portions 94' of the longitudinally extending members are disposed at right angles to their associated longitudinally extending members proper. The opposing ends of end legs 92 are of a reduced diameter with such end portions being snugly received within the above mentioned end portions 94' in telescoped mating relationship.

The end legs 92 of a first one of the frames 90 are in a cross-over relationship with the adjacent end legs 92 of the other frame 90. Each of the end legs 92 has a bight portion 96 formed therein with the bight portions 96 of the end legs of one frame 90 being in mating or interlaced relationship with the bight portions 96 of the other frame. These mating bight portions 96 serve to define pivot joints which permit pivotal movement of the frames 90 relative to one another between a folded position wherein the frames are generally parallel to a common plane with the longitudinally extending members 94 of a first one of the frames being in juxtaposition with the longitudinally extending members of the other frame and an open support position wherein the frames 90 are angularly arranged relative to one another with the longitudinally extending members 94 of one frame being spaced a substantial distance from the longitudinally extending members of the other frame. The folded positions of the frames 90 are illustrated by the dashed lines in FIG. 2.

Each of the pivot joints is provided with a housing 98 which embraces the end legs 92 of the frames in the region of each pivot joint. These housings 98 are adapted to maintain the bight portions 96 of the end legs in the required interlaced mating relationship and they also serve to define the open support position of one frame 90 relative to the other.

The pivot joint housings 98 each comprise a shell-like enclosure defined by a pair of opposed identically shaped plates 98'. Each of these plates 98 is so shaped as to provide a generally V-shaped ledge extending inwardly from each of its opposing ends. These V-shaped ledges define internal shoulders 100 against which portions of the end legs 92 bear when the frames are in the open position whereby the shoulders 100 take up the laterally directed components of force and thereby serve to define the "open" support position of the frames. Since the internal shoulders 100 serve to take up all of the laterally directed thrust forces, substantially only vertically directed force components are transmitted between the support stand and the clips 26 provided on the above described assembly 22. This feature greatly reduces the possibility of failure of the resilient clips 26 during use particularly when relatively heavy loads are being applied to the assembly 22.

The mating halves 98' of the housing 98 are secured together in any suitable fashion, as, for example, by spot welds.

The shape of the end legs 92 in the region of the bight portion 96 is clearly shown in FIGS. 8, 9 and 10. The bight portions 96 are defined by a smoothly contoured portion of the end leg 92 which is off-set from the remaining portions of the end leg by a distance equal to one-half the outside diameter of the end leg. With reference to FIG. 8, it will be seen that the leg portions are opposing sides of bight 96 are off-set relative to one another such that they lie on opposing sides of an imaginary plane B—B. It follows that the upper portion of each frame 90, that is, that portion above bight portion 96, is off-set to one side of an imaginary plane relative to its lower portion i.e., that portion below the bight portion 96. By virtue of this off-set relationship, the above-referred to pivotal movement of the frames into the folded position in close juxtaposition with one another is facilitated.

Figure 11:
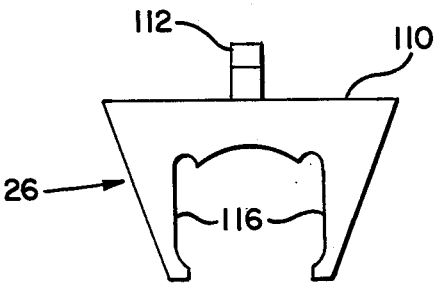
FIG. 11 is a side view of the resilient clip.
Figure 12:
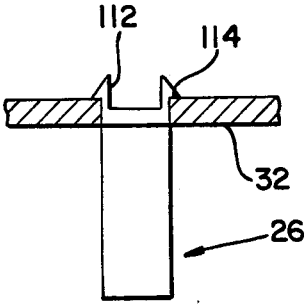
FIG. 12 is an end view of the resilient clip shown inserted into a slot formed in a transverse frame of the workpiece clamping assembly.

FIGS. 11 and 12 are side and end elevation views respectively of the previously referred to resilient clip 26. The clips 26 are preferably made of a rugged plastics material. Each clip 26 includes a flat base portion 110 which rests against the flat lower surface of the associated transverse frame member 32 (see FIG. 5). This flat base portion is provided with a pair of upwardly extending tangs 112 each of which is provided with a tapered head portion defining a hook portion 114 thereon. The transverse frame members 32 are provided with spaced apart slots arranged to receive tangs 112 in such a manner that the tangs 112 may be inserted thereinto in a snap-fitting relationship with the hooks 114 serving to retain the clips 26 firmly on the frame members 32 as shown in FIG. 12.

It will be also noted that each clip 26 is provided with a downwardly extending pair of arms 116, which arms, together with the base portion of the clip, serve to define a generally C-shaped opening of sufficient dimensions as to receive therein an associated one of the longitudinally extending members 94 of the support frame.

The slots or openings in the transverse frame members 32 which serve to receive tangs 112 of clips 26 are dimensioned so as to permit each clip 26 to have a certain degree of lateral freedom in the direction indicated by arrows X in FIG. 8 so that each clip 26 is capable of moving laterally a sufficient distance to compensate for tolerance accumulations and any deflections due to loading in the base frame 28 and in the frames 90 of the support stand. This helps to ensure that vertically directed force components only are transmitted between the support stand 90 and the base frame 28. In other words, by permitting the clips 26 to move laterally a short distance, one is assured that all of the laterally directed force components are taken up by the internal shoulders 100 of the pivot joint housings 98. Thus, the possibility of failure of the resilient clips 26 occurring under heavy load conditions is significantly reduced.

Figure 13:
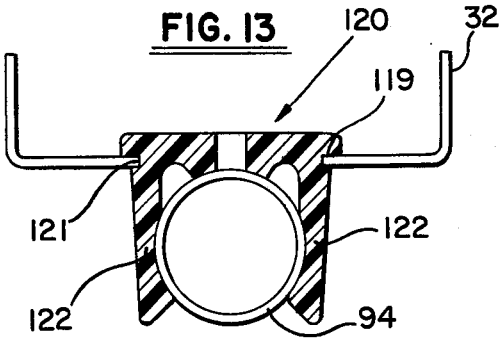
FIG. 13 is a section view of an alternate and preferred embodiment of a resilient clip shown fitted into a rectangular opening formed in a transverse frame of the workpiece supporting and clamping assembly.

FIG. 13 illustrates an alternate and preferred embodiment of a resilient clip 120 wherein the clip is configured to enable the workpiece supporting and clamping assembly 22 to be supported upon the stand in one mode, and in another mode, to be supported on a table-like work surface such as a workbench.

In FIG. 13, the resilient clip is provided with a groove 119 with aid of which it is fitted into a rectangular slot or opening 121 in a transverse frame 32 of the workpiece supporting and clamping assembly 22. The arms 122 engage a horizontally extending member 94 of the support frame 24. Since the arms 122 are resilient, they tightly engage the horizontally extending member 94.

Figure 14:
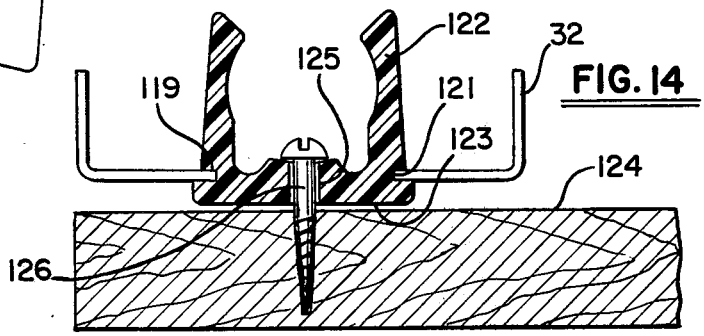
FIG. 14 is a section view of the resilient clip of FIG. 13 shown positioned inverted in the transverse frame to facilitate placement of the workpiece supporting and clamping assembly on a table-like surface.

By inverting the resilient clip 120 and inserting it into the opening 121 of the transverse frame member 32 as shown in FIG. 14, the base surface 123 serves as an excellent footing upon which the assembly 22 can be supported on the table-like surface of a workbench 124. A round through opening 125 is provided should it be desired to more securely mount the clamping assembly 22 on the workbench 124 with the aid of a screw 126.

Figure 15:
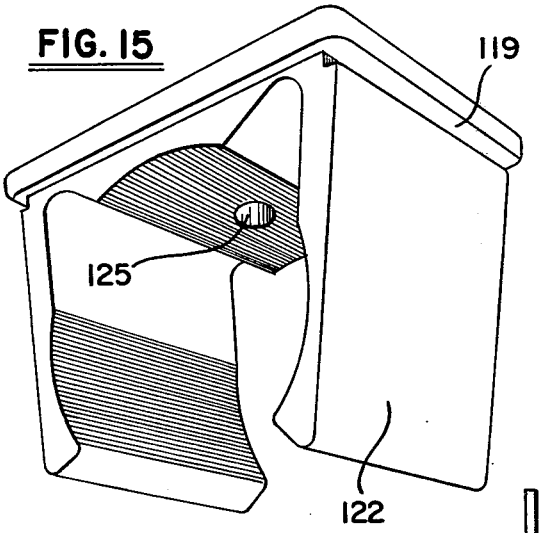
FIG. 15 is a perspective view of the resilient clip shown in FIGS. 13 and 14.

In FIG. 15 is shown a perspective view of the preferred configuration of the resilient clip which clearly shows the generally C-shaped opening dimensioned to receive therein an associated one of the longitudinally extending members 94 of the support frame 24.

Figure 16:
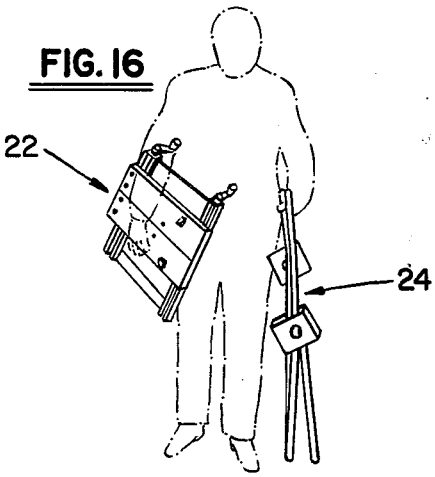
FIG. 16 illustrates the manner in which the workbench is carried from one location to another.

FIG. 16 illustrates the manner in which the workbench is carried from one place to another. The workpiece supporting and clamping assembly 22 may be easily carried under one arm while the support stand 24 is carried by the other arm. This affords a generally balanced load distribution thus enabling the average person to carry the workbench relatively long distances without fatigue.

Figure 17:
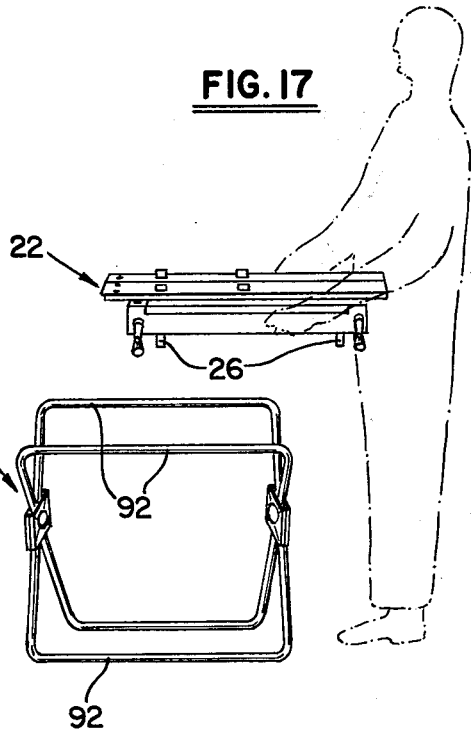
FIG. 17 illustrates the manner in which the workpiece supporting and clamping assembly is positioned or removed from the support stand; and, FIG. 18 is a perspective view of the workbench showing the workpiece supporting and clamping assembly as being offset relative to the support stand.

After the workbench has been carried by the user to the work site, the two frames 90 of the support stand are pivoted relative to one another to the "open" position. The workpiece supporting and clamping assembly 22 is then grasped along its opposing sides in the manner illustrated in FIG. 17 and is then positioned over the support stand and lowered downwardly until the resilient clips 26 engage around the upper horizontally disposed longitudinally extending members 92. The workbench is then ready for use.

It will be noted here that the lower horizontally extending members 94 provide a relatively large support area thus ensuring stability of the workbench even when working on soft or on uneven ground. The user may place one foot on one of the members 92 to further stabilize the workbench during certain operations.

When the user is finished with the workbench, he simply lifts the assembly 22 off the support stand 24 and pivots the frames 90 thereof to the "closed" position and carries the two assemblies back to the storage place. Since assembly 22 and support stand 24 are relatively compact, they occupy little room in storage; furthermore, by virtue of the compactness of the two assemblies, packaging and shipping costs are reduced.

Figure 18:
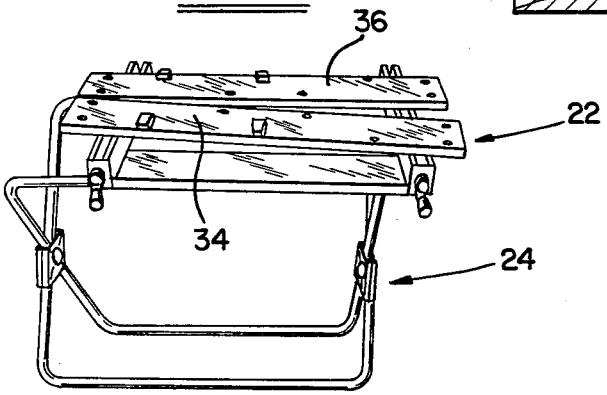

Under ordinary circumstances, the assembly 22 will be positioned such that its axis of symmetry coincides substantially with the axis of symmetry of support stand 24. However, as illustrated in FIG. 18, the user may, on occasion, wish to displace the assembly 22 such that one end of same overhangs one end of support stand 24. Since the resilient clips 26 are located on assembly 22 inwardly of the opposing ends of same, the entire assembly 22 can easily be displaced endwise a substantial distance relative to the support stand.

In the foregoing description and illustration, a particular embodiment of the invention has been specifically described by way of example. Various changes and modifications will be apparent to those skilled in the art and it is intended that the appended claims cover all such changes as may fall within the true spirit and scope of this invention.

I claim:

1. A portable workbench comprising:

a foldable support stand;

a workpiece supporting and clamping assembly supported thereon, the workpiece supporting and clamping assembly including a base frame; a pair of elongated top members located on the base frame and defining upper work supporting surfaces lying generally in a common plane and having opposed side portions defining clamping surfaces; and, clamping means operatively connected between said base frame and one of the top members for moving the latter toward and away from the other top member to provide for the clamping of workpieces between the top members;

said support stand including: a pair of generally rigid frames, each frame including a spaced apart pair of end legs and an upper longitudinally extending generally horizontal member, interconnecting said end legs;

pivot means for pivotally connecting said frames together at corresponding ones of said end legs of said frames below said horizontal members to permit said frames to be pivoted relative to one another between an open support position where the frames are angularly arranged relative to one another with their horizontally extending members being spaced a predetermined distance apart, to a folded position wherein the frames are in juxtaposition to one another, said pivot means including stop means for defining said open position and preventing collapse of said support stand in said open position;

resilient clip means for releasably engaging said upper horizontal members when the support stand is in the open support position to secure said workpiece supporting and clamping assembly to the support stand when in use and to permit the workpiece supporting and clamping assembly to be removed therefrom to facilitate handling and storage of the portable workbench; and, slot means formed in said base frame so as to extend transversely to said horizontal members;

said resilient clip means having engaging means slideably engaging said slot means to permit said horizontal members to move relative to said base frame to change said predetermined distance in response to deflections of said frames about said pivot means produced by forces applied by an operator to said assembly, said forces being transmitted from said assembly to said frames through said resilient clip means.

2. The portable workbench of claim 1, said engaging means being a pair of upwardly extending resilient tangs having respective hook portions formed thereon, said tangs being insertable into said slot means in a snap fitting relationship whereby said hook portions retain said clip means firmly on said base frame.

3. The portable workbench of claim 1, each of said frames including a lower longitudinally extending generally horizontal member interconnecting said end legs.

* * * * *